US006142526A

United States Patent [19]

Katz

[11] Patent Number: 6,142,526

[45] Date of Patent: Nov. 7, 2000

[54] SPEED CONTROL POLE FOR IN-LINE SKATING

[76] Inventor: David L. Katz, 465 Tom Swamp Rd., Mt. Carmel, Conn. 06518

[21] Appl. No.: 09/251,098

[22] Filed: Feb. 16, 1999

[51] Int. Cl.[7] ..... A63C 11/00

[52] U.S. Cl. ..... 280/809; 280/826; 280/823; 280/11.2; 188/4 B; 188/5; 135/75; 135/85

[58] Field of Search ..... 280/11.2, 826, 280/823, 809; 188/4 R, 4 B, 5; 135/75, 85, 86

[56] References Cited

U.S. PATENT DOCUMENTS

| | | | |
|---|---|---|---|
| D. 262,646 | 1/1982 | Mace . | |
| 3,963,037 | 6/1976 | Clark | 280/11.37 |
| 4,194,751 | 3/1980 | Shinmure | 280/11.2 |
| 4,288,102 | 9/1981 | Ramer | 280/823 |
| 4,386,794 | 6/1983 | Roberts | 280/826 |
| 4,402,529 | 9/1983 | Cavazza | 280/823 |
| 4,448,442 | 5/1984 | Weber-Henning et al. | 280/823 |
| 4,596,405 | 6/1986 | Jones | 280/823 |
| 4,756,524 | 7/1988 | Cooney . | |
| 5,163,710 | 11/1992 | Chirtel et al. . | |
| 5,236,222 | 8/1993 | Fletcher . | |
| 5,312,135 | 5/1994 | Karabees . | |
| 5,397,137 | 3/1995 | Pellegrine, Jr. et al. | 280/11.2 |
| 5,468,004 | 11/1995 | Olson et al. | 280/11.2 X |
| 5,497,857 | 3/1996 | Warren et al. | 188/4 R |
| 5,653,468 | 8/1997 | Ostapyk | 280/809 |
| 5,687,991 | 11/1997 | Gairdner . | |
| 5,785,326 | 7/1998 | Chang | 280/11.2 |
| 5,860,492 | 1/1999 | Talaska | 188/5 X |
| 5,938,240 | 8/1999 | Gairdner | 280/826 |

*Primary Examiner*—Lanna Mai
*Assistant Examiner*—Toan To
*Attorney, Agent, or Firm*—Bachman & LaPointe, P.C.

[57] ABSTRACT

The present invention relates to a speed control pole to be used by a skater. The speed control pole has an elongated shaft with an upper end and a lower end, a roller/wheel mounted to the lower end of the shaft, a braking mechanism for contacting the roller, and a hand grip system for actuating the braking mechanism. The braking mechanism includes a brake pad which is caused to be moved inwardly against the roller and downwardly into contact with a skating surface when actuated. The brake pad includes an arcuately shaped surface for contacting the roller and a lower surface formed by two angled substantially planar surfaces. During a braking mode of operation, the arcuately shaped surface is brought into contact with the roller. During a pushing off mode of operation, the arcuately shaped surface remains in contact with the roller and the substantially planar surfaces are sequentially brought into contact with the skating surface.

16 Claims, 4 Drawing Sheets

SPEED CONTROL POLE FOR IN-LINE SKATING

BACKGROUND OF THE INVENTION

The present invention relates to a speed control pole for providing a skater, in particular an in-line or roller blade skater, with improved braking ability and an improved ability to ascend hills.

In-line or roller blade skating has become a popular form of exercise. People using in-line skates are easily able to achieve relatively high speeds, particularly when descending hills. Most in-line skates come with a braking system. Typically, the braking system consists of a brake pad on the heel of one skate. In order to move the brake pad into frictional engagement with the skating surface, the skater must bend one leg, shift body weight to that leg, and thrust the braking leg forward while canting the heel downwards to bring the brake pad into contact with the skating surface. This is an awkward maneuver which is difficult to learn and perform, especially if the skating surface is rough or uneven. Consequently, stopping is difficult and is a factor in the majority of injuries resulting from in-line skating.

A number of devices have been invented to improve the ability of a skater to stop and/or to provide the skater with greater stability. U.S. Pat. Nos. 5,312,135 to Karabees; 5,653,468 to Ostapyk; and 5,687,991 to Gairdner illustrate some of these devices. The Karabees patent illustrates an elongated shaft adapted to be held manually by a skater and to be used as a balance beam as well as a braking device. The shaft has a roller on at least one end, which roller is adapted to be biased against a skating surface. The shaft also includes a brake mechanism located intermediate the ends of the shaft. The brake mechanism is controllable by the skater for braking rotation of the roller.

The Ostapyk patent illustrates another device which is intended to be used as a stabilizing beam as well as a braking device. The device has a first end which supports a brake pad for stopping a skater. A second end of the beam detachably retains an insert for supporting an implement useful for stabilizing the skater. The implement may be another brake pad, a free turning wheel or a hockey stick blade.

The Gairdner patent illustrates a device for braking a skater. This device comprises an elongated shaft having an arm clamp attached at its upper end to grip a skater's arm and a wheel rotatably connected to its lower end. A hand grip and a braking handle are located near the upper end of the shaft and can be grasped by the skater's hand to activate a wheel braking mechanism. In use, the shaft is attached to the skater's arm and extends forwardly and downwardly from the arm, so that when braking is to occur, the skater triangulates forwardly onto the shaft which supports the skater's weight against falling and provides braking.

While these devices are helpful in providing skaters with improved braking capability and balance, they are difficult to use, particularly for the beginner skater. Further, they really do not address the needs for providing skaters with an improved ability to ascend or climb hills.

Devices in the nature of ski poles also are known in the prior art. U.S. Pat. No. 4,756,524 to Cooney illustrates one such pole which is intended to for use by walkers, joggers and runners. The pole has a frame with a handgrip and a foot thereon. The foot is designed for ground and other supporting surface contact and for the provision of a rocking motion to the frame.

It has been suggested that poles of these nature can be adapted for use by roller skaters. U.S. Pat. Nos. 5,163,710 to Chirtel et al. and U.S. Pat. No. 5,326,222 to Fletcher, as well as U.S. Design Pat. No. 262,646 to Mace, illustrate ski poles which have been adapted for use by in-line or roller skaters. The Mace pole is relatively simple in design and consists of a pole having a handgrip at one end and a pad at the other end. The Chirtel et al. pole has a similar construction. The Fletcher pole device has an elongated shaft with a handle portion on one end and a foot portion on the other end. First and second pads are mounted in the foot portion. The first pad is constructed of a type adapted to frictionally grip the skate surface so that the skater may exert a thrusting motion with the skate pole. The material forming the first pad may be a stiff, yet resilient, rubber-like substance such as a soft thermoplastic. The second pad is constructed of a different type of material, such as a hard thermoplastic, that is adapted to act as a brake pad against the skate surface so that the skater may apply a drag force.

Despite the existence of these devices, there remains a need for a pole which allows an in-line skater to have improved braking ability when descending hills and an improved ability to climb hills.

SUMMARY OF THE INVENTION

Accordingly, it is an object of the present invention to provide a pole which provides a skater with an improved ability to brake and an improved ability to ascend hills.

It is a further object of the present invention to provide a pole as above which is relatively easy to use.

The foregoing objects are attained by the speed control pole of the present invention.

In accordance with the present invention, a speed control pole for use by a skater comprises an elongated shaft having an upper end and a lower end, a roller/wheel mounted to the lower end of the shaft, brake means for contacting the roller, and means for actuating the brake means. The brake means are mounted to the lower end of the shaft so as to pivot inwardly against the roller and to move downwardly into contact with the skating surface when actuated by the actuating means. In a preferred embodiment of the invention, the brake means further includes means for allowing a skater to push off the skating surface and thereby enhance the skater's ability to ascend an inclined skating surface. This means for pushing off comprises a first substantially planar surface along a bottom portion of the brake means and a second substantially planar portion positioned at an angle with respect to the first substantially planar portion.

Other details of the speed control pole of the present invention, as well as other objects and advantages attendant thereto, are set forth in the following description and the accompanying drawings, wherein like reference numbers depict like elements.

DETAILED DESCRIPTION OF THE PREFERRED EMBODIMENT(S)

Figure 1:
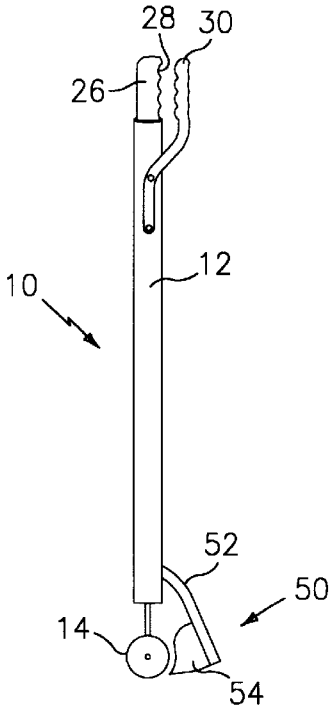
FIG. 1 is a front view of one embodiment of a speed control pole in accordance with the present invention.
Figure 3:
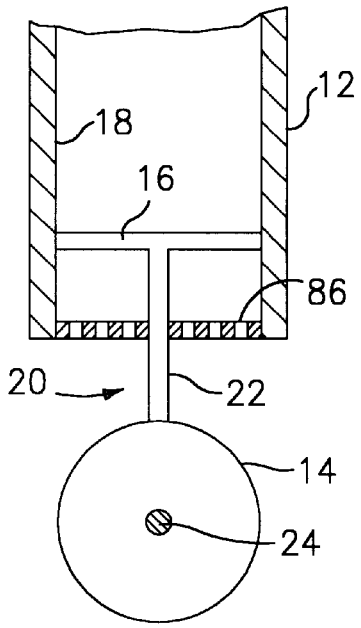
FIG. 3 is a sectional view of the lower portion of the pole of FIG. 1.

Referring now to the drawings, FIG. 1 illustrates one embodiment of a speed control pole 10 in accordance with the present invention. The speed control pole 10 has an elongated, hollow shaft 12 to which a roller/wheel 14 is mounted at its lower end. The roller 14 may be mounted to the shaft 12 in any desired manner. For example, as shown in FIG. 3, two cross bars 16 may be welded, adhesively bonded, or otherwise attached to interior side walls 18 of the shaft 12. An angled support member 20 is integrally formed with the cross bars 16. If desired, the cross bars 16 may be omitted and the support member 20 may be directly attached to the side walls 18.

Figure 4:
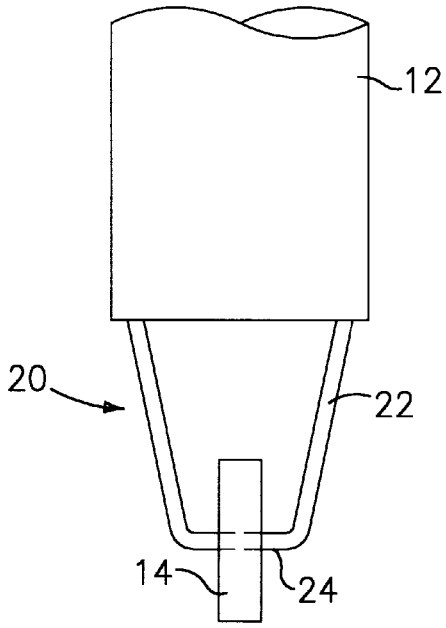
FIG. 4 is a side view of the lower portion of the pole of FIG. 1.

The angled member 20, as shown in FIG. 4, includes downwardly extending portions 22 and right angle portions 24 which serve as an axle for the roller 14. The roller 14 may be secured to the portions 24 by any suitable conventional means (not shown) known in the art. The roller 14 preferably includes an integral bushing (not shown) for allowing rotation about the portions 24.

The pole 10 further has a first hand grip 26 fixed to an upper end of the shaft 12. As shown in FIG. 1, the hand grip 26 has a plurality of grooves 28 to accommodate the fingers of a skater's hand.

Figure 5:
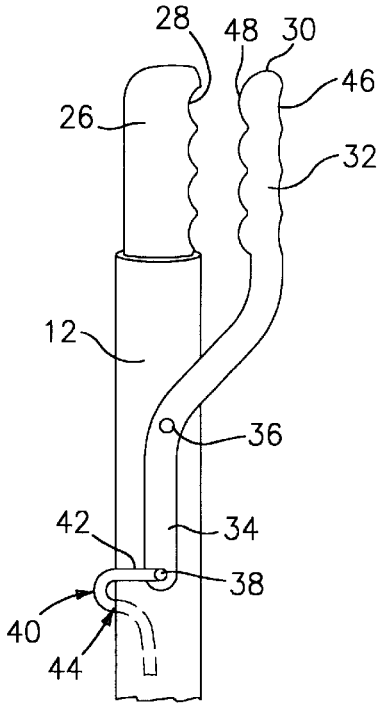
FIG. 5 is an enlarged side view of an upper portion of the speed control pole of FIG. 1.

Referring now to FIGS. 1 and 5, the pole 10 also has a second hand grip 30 pivotally connected to an upper end of the shaft 12. The hand grip 30 has an upper portion 32 and two integral downwardly extending side portions 34. Each side portion 34 has an aperture for receiving one end of a pivot pin 36 about which the hand grip 30 rotates. One of the side portions 34 further has a locking nut 38 for receiving one end 42 of a control cable 40, which end 42 passes through an aperture 44 in the upper end of the shaft 12.

The upper portion 32 of the hand grip 30 has grooved surfaces 46 and 48. Grooved surface 46 has a plurality of grooves for receiving the fingers of a skater's hands. Grooved surface 48 has a set of ridges which mate with the grooves 28 in the first hand grip 26.

In operation, the hand grip 30 is manually moved between a first position where the surface 48 is spaced from the hand grip 26 and a second, engaged position where the ridges in the grooved surface 48 are mated with the grooves 28 in the first hand grip 26.

Figure 2:
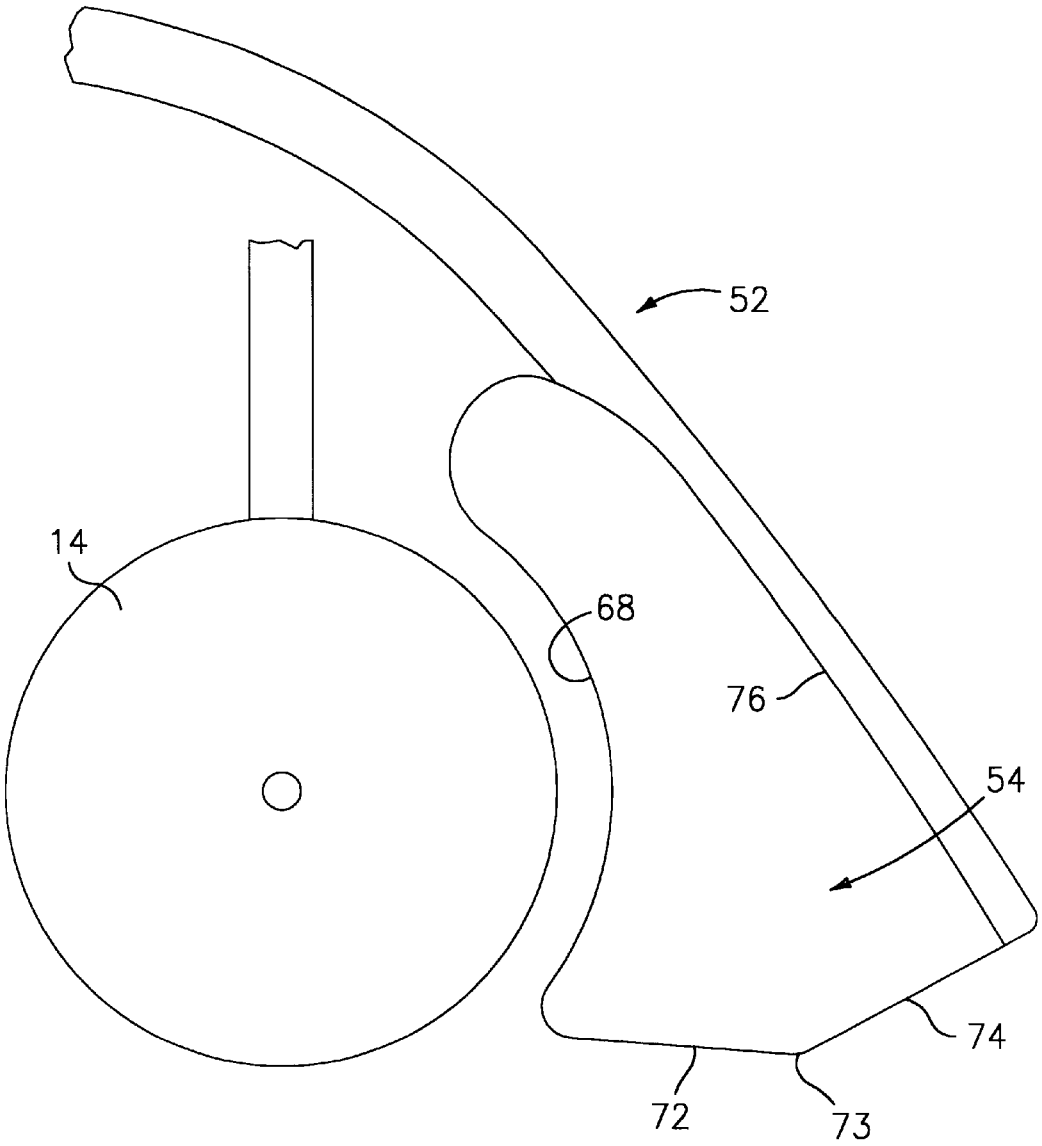
FIG. 2 is an enlarged side view of the braking mechanism for the speed control pole of FIG. 1.

A braking mechanism 50 is mounted to the lower end of the shaft 12 as shown in FIG. 1. Referring now to FIG. 2, the braking mechanism 50 preferably comprises an arcuate sheath 52 and a brake pad 54. The brake pad 54 may be permanently affixed or removably affixed to the sheath 52 in any suitable manner known in the art.

Figure 6:
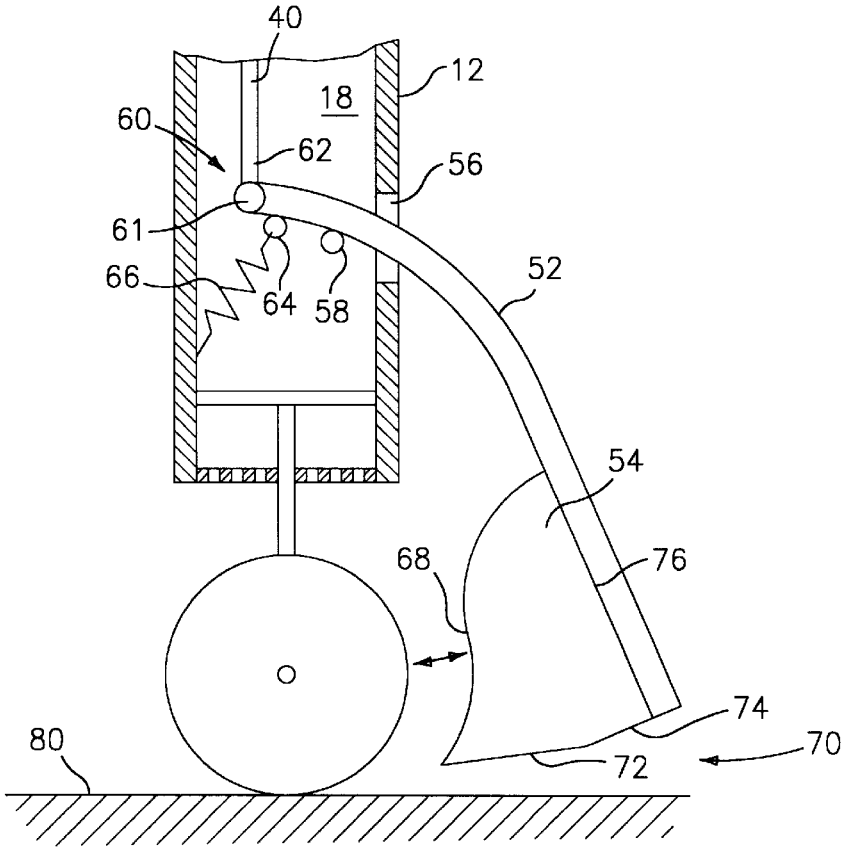
FIG. 6 is another sectional view of the lower portion of the speed control pole of FIG. 1.

Referring now to FIG. 6, the arcuate sheath 52, in a preferred construction, passes through an aperture 56 in the shaft 12 and is pivotally connected to a pin 58 affixed to the side walls 18 of the shaft 12. Any suitable conventional means known in the art may be used to pivotally connect the sheath 52 to the pin 58. One end 60 of the sheath 52 includes an aperture 61 for receiving an end 62 of the control cable 40 and a second aperture 64 for receiving an end of a spring 66 for holding the braking mechanism in a retracted non-engagement position. The spring 66 may have its opposite end secured to a side wall 18 of the shaft 12 by any suitable conventional means known in the art. The sheath 52 may be formed from any suitable material known in the art such as aluminum, an aluminum alloy, other lightweight metallic materials, or a plastic material.

The brake pad 54 may be formed from any suitable material known in the art including a ceramic material or a hard rubber material. As shown in FIGS. 2 and 6, the brake pad 54 has an arcuately shaped inner surface 68 which contacts a surface of roller 14 when the braking mechanism is engaged. The brake pad 54 further has a bottom portion 70 formed by two substantially planar surfaces 72 and 74. Still further, the brake pad 54 has a rear surface 76 which connects one end of the bottom portion 70 to one end of the surface 68. The rear surface 76 preferably conforms to the shape of the sheath 52.

As previously discussed, a control cable 40 is provided which runs through the interior of the shaft 12. The control cable 40 has one end 42 attached to the locking nut 38 and a second end 62 attached to the aperture 61 in the sheath 52. The control cable 40 may have a single cable construction or a coaxial cable construction where an inner cable is protected by an outer sheath. Further, the control cable 40 may be formed from any suitable material known in the art such as steel and may be secured to the side walls 18 of the shaft 18 in any desired manner.

In operation, a skater looking to slow down positions the pole so that the base of the pole is out in front. He/She then applies the braking mechanism 50 by gripping the grooved surface 46 of the hand grip 30 and closing his/her fist. This causes the hand grip 30 to rotate about the pivot pin 36, thereby causing the lower portion of the hand grip 30 with the locking nut 38 to move away from the shaft 12. This, in turn, pulls the cable 40 which causes the end 78 of the sheath 52 to move upwardly against the action of spring 66 and the brake pad 54 to move inwardly towards the roller 14 and downwardly until the first planar surface 72 is in contact with the skating surface 80. The contact between the surface 68 and the roller 14 creates a braking action which gradually prevents rotation of the roller 14. The frictional contact between the surfaces 72 and 80 creates an additional braking force.

To release the brake, a skater merely needs to open his/her fist and release the hand grip 30. The spring 66 causes the cable 40 to be withdrawn back into the shaft 12 and the sheath 52 to pivot about the pin 58 so as to rotate the brake pad 54 back into a non-engaging position. The withdrawal of the cable 40 back into the shaft 12 also causes the hand grip 30 to return to the position where the surface 48 is spaced from the first hand grip 26.

If a skater is climbing an inclined surface and needs to push off the skating surface 80 to help his/her movement up the inclined surface, the skater places the pole 10 so that its base is slightly behind him/her and closes his/her fist around the grip 30 so as to apply the braking mechanism 50. This brings the surface 72 into contact with the skating surface 80 and enables the skater to push off the surface 80. By applying a pushing off motion, as one would do with a ski pole, the skater pivots the pole 10 about the point 73 where the surfaces 72 and 74 meet, thus bringing the surface 74 into contact with the surface 80. This allows the skater to continue pushing off the surface 80 and enhance his/her ability to ascend an inclined surface such as a hill.

Figure 7:
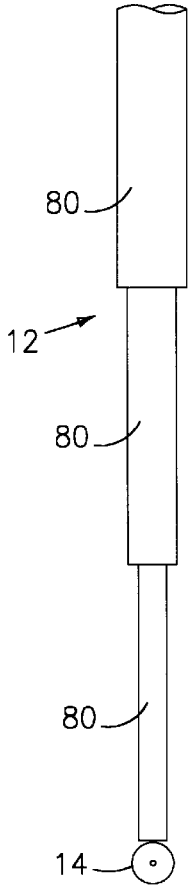
FIG. 7 illustrates an alternative embodiment of a speed control pole in accordance with the present invention.
Figure 8:
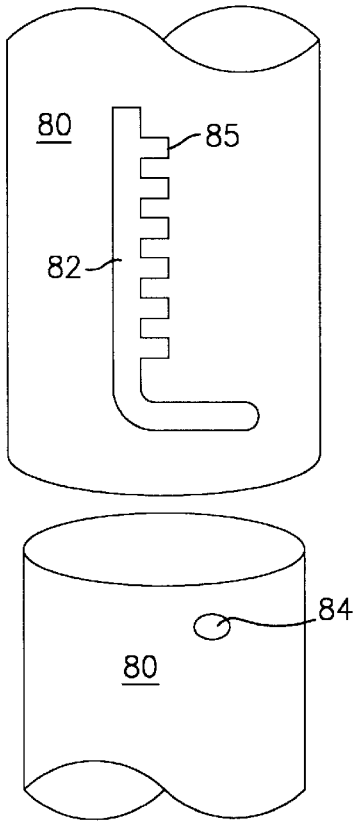
FIG. 8 is an exploded view of a portion of the pole of FIG. 7.
Figure 9:
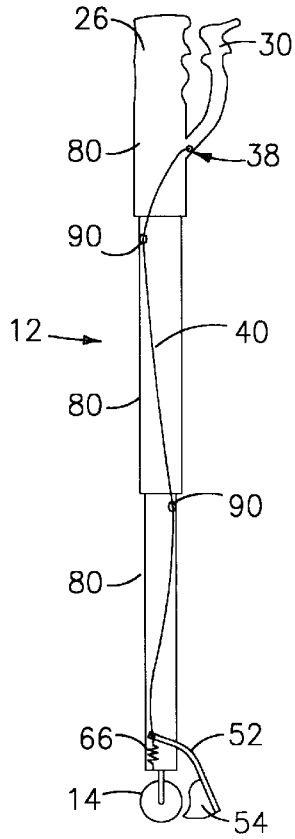
FIG. 9 is a sectional view of the pole of FIG. 7 illustrating the positioning of the cable within the pole.

Referring now to FIGS. 7–9, the control pole 10 of the present invention, if desired, may be formed from a plurality of sections 80 which are adjustable relative to each other so as to enable the poles to be used by skaters of different heights. While the shaft 12 may be formed from two adjustable sections 80, in a preferred construction, it is formed from at least three adjustable sections.

FIG. 8 illustrates one technique for making the pole 10 adjustable in length. In this technique, at least one of the telescoping sections 80 is provided with a track 82, while at least one other of the sections 80 is provided with a follower or knob 84 which moves along the track 82. A plurality of recesses 85 are provided along the length of the track for receiving the follower 84 and locking adjacent telescoping sections 80 in a desired position. Thus, one section 80 may be telescoped within an adjacent section 80 by rotating one section relative to the other and moving the follower 84 upwardly or downwardly along the track 82.

In an alternative technique, one or more sections may have an interior thread which engages an exterior thread on an adjacent section.

In yet another alternative technique, one or more sections may have a plurality of apertures for receiving a spring loaded pin attached to an adjacent section.

Referring now to FIG. 9, to prevent the control cable 40 from getting tangled or snagged on the telescoping sections 80, a number of rings 90 may be secured to the interior surfaces of the sections 80. The cable 40 is then arranged to pass through the rings 90 and thereby avoid getting tangled or snagged.

In use, the pole 10 is likely to encounter interior moisture within the shaft 12. To prevent corrosion and to allow the drainage of any moisture, the lower end of the shaft 12 is provided with a screen-like member 86. The member 86 may be formed from any suitable perforated material or mesh known in the art and may be connected to the shaft walls 18 in any desired manner known in the art.

In use, a skater would hold a pole 10 in each hand. To brake when going down hill, the skater would hold each pole 10 out in front and close his/her fist around the grip 30. To brake when going up hill, the skater would hold each pole 10 so that the upper portion was in front of the skater and the roller 14 was alongside or behind the in-line skates.

If a skater wanted to push off the inclined skating surface when going up a hill, the skater would hold each pole slightly behind or along side the heel of the skates and close his/her fist around the grip 30 to apply the brake. The skater then pushes off the pole much in the manner that a skier pushes off a ski pole. As previously discussed, this bring the surface 72 into contact with the skating surface 80 and then the surface 74 into contact with the surface 80.

While it is preferred that the shaft 12 be straight along its length, the shaft 12 could be curved in a manner comparable to aerodynamically shaped racing ski poles.

While the control cable 40 has been shown as being positioned within the shaft 12, it is possible to position the cable externally of the shaft 12. If the cable 40 is positioned externally of the shaft 12, then the end 62 may be connected to an external portion of the sheath 52 which extends outside of the shaft 12.

The locking nut 38 may comprise any suitable locking nut known in the art and may be used, if desired, to adjust the tension in the control cable 40.

While the pole 10 of the present invention is intended to be used with in-line or roller blade skates, it could be used with other wheeled devices such as skateboards or roller skates. Therefore, the term "skater" as used herein refers to a person who is using either in-line skates, roller blades, a skateboard, roller skates, or some other wheeled recreational device.

It is apparent that there has been provided in accordance with the present invention a speed control pole for in-line skating which fully satisfies the means, objects, and advantages set forth hereinbefore. While the present invention has been described with reference to specific embodiments thereof, other alternatives, modifications, and variations will be apparent to those skilled in the art after reading the disclosure. Therefore, it is intended to embrace all such alternatives, modifications, and variations which fall within the spirit and broad scope of the appended claims.

What is claimed is:

1. A speed control pole for use by a skater comprising:

an elongated shaft having an upper end and a lower end;

a roller mounted to said lower end of said shaft, said roller contacting a skating surface;

brake means for contacting said roller and means for actuating said brake means; and said brake means being mounted to said lower end of said shaft so as to pivot inwardly against said roller and to move down into contact with said skating surface when actuated by said actuating means, said brake means having an arcuately shaped interior surface for contacting said roller when said brake means is actuated in a partial braking mode when said shaft is in a first orientation with respect to the skating surface and for contacting said roller while a bottom portion of said brake means contacts said skating surface when said brake means is operated in a full braking mode when said shaft is in a second orientation with respect to said skating surface.

2. A pole according to claim 1, wherein said brake means further includes means for allowing a skater to push off the skating surface and thereby enhance the skater's ability to ascend an inclined skating surface.

3. A pole according to claim 1, wherein said means for allowing a skater to push off comprises a first substantially planar portion along said bottom portion of said brake means and a second substantially planar portion positioned at an angle with respect to said first substantially planar portion.

4. A pole according to claim 3, further comprising:

a first hand grip attached to said upper end of said shaft; and said actuating means comprising a second hand grip pivotally mounted to said upper end of said shaft.

5. A pole according to claim 4, wherein said first hand grip is shaped to accommodate a skater's fingers and said second hand grip has a first surface shaped to accommodate a skater's fingers and a second surface shaped to mate with said first hand grip.

6. A pole according to claim 4, further comprising:

said shaft being hollow; and said actuating means further comprising cable means extending between said second hand grip and said brake means, said cable means running through said hollow shaft.

7. A pole according to claim 1, further comprising spring means attached to said brake means for holding said brake means in a retracted position when said brake means is not being actuated by said actuating means.

8. A pole according to claim 7, wherein said spring means are positioned within said shaft.

9. A pole according to claim 1, wherein said shaft comprises at least two telescoping sections.

10. A pole according to claim 1, wherein said shaft comprises at least three telescoping sections.

11. A pole according to claim 1, wherein said brake means further comprises a sheath extending through an opening into the interior of said shaft and a brake pad attached to a surface of said sheath, and wherein said sheath is pivotally connected to said shaft and a surface of said brake pad forms said arcuately shaped interior surface.

12. A pole according to claim 11, wherein said brake pad is formed from a hard rubber or a ceramic material.

13. A pole according to claim 1, further comprising:

said shaft being hollow; and a screen member forming at least a portion of said lower end of said shaft so as to allow any moisture within said shaft to drain.

14. A pole for use by a skater comprising:

an elongated shaft having an upper end and a lower end;

a roller connected to said lower end;

a first hand grip fixedly connected to said upper end;

a second hand grip pivotally connected to said upper end;

a braking mechanism attached to a lower end of said shaft, said braking mechanism having a brake pad for contacting a surface of said roller;

said brake pad having a bottom portion for contacting a skating surface on which said skater is skating, said bottom portion having two angled surfaces; and a cable extending between said second hand grip and said braking mechanism for causing said brake pad to move inwardly towards said roller and downwardly towards said skating surface when said roller is in engagement with said skating surface to place at least one of said angled surfaces into contact with said skating surface when said second hand grip is actuated.

15. A pole according to claim 14, further comprising:

said shaft being hollow;

said cable being positioned substantially within said hollow shaft and being connected to a locking nut on said second hand grip.

16. A pole according to claim 15, further comprising:

a spring positioned within said hollow shaft; and said spring holding said braking mechanism in a retracted position when said second hand grip is in an inactive position.

* * * * *